US007329024B2

(12) United States Patent
Lynch et al.

(10) Patent No.: US 7,329,024 B2
(45) Date of Patent: Feb. 12, 2008

(54) LIGHTING APPARATUS

(75) Inventors: Manuel Lynch, Tustin, CA (US); Lenny Fraitag, San Diego, CA (US); Rehana Wijesinghe, Colombo (LK)

(73) Assignee: Permlight Products, Inc., Tustin, CA (US)

( * ) Notice: Subject to any disclaimer, the term of this patent is extended or adjusted under 35 U.S.C. 154(b) by 0 days.

(21) Appl. No.: 10/945,069

(22) Filed: Sep. 20, 2004

(65) Prior Publication Data

US 2005/0190553 A1 Sep. 1, 2005

Related U.S. Application Data

(60) Provisional application No. 60/505,267, filed on Sep. 22, 2003, provisional application No. 60/546,273, filed on Feb. 20, 2004.

(51) Int. Cl.
*F21V 11/00* (2006.01)

(52) U.S. Cl. ..... 362/240; 362/294; 362/394; 257/99

(58) Field of Classification Search ..... 362/240, 362/231, 249, 365, 800; 257/99; 200/314
See application file for complete search history.

(56) References Cited

U.S. PATENT DOCUMENTS

| | | | | |
|---|---|---|---|---|
| 4,729,076 | A | | 3/1988 | Masami |
| 4,855,882 | A | | 8/1989 | Boss |
| 5,278,432 | A | | 1/1994 | Ignatius |
| 5,296,310 | A | | 3/1994 | Kibler et al. |
| 5,410,112 | A | * | 4/1995 | Freeman ..... 200/50.1 |
| 5,430,627 | A | | 7/1995 | Nagano |
| 5,499,170 | A | | 3/1996 | Gagne |
| 5,607,227 | A | | 3/1997 | Yasumoto et al. |
| 5,697,175 | A | | 12/1997 | Schwartz |
| 5,746,497 | A | | 5/1998 | Machida |
| 5,785,411 | A | | 7/1998 | Komai et al. |
| 5,857,767 | A | | 1/1999 | Hochstein |
| 5,863,467 | A | | 1/1999 | Mariner et al. |
| 5,953,469 | A | | 9/1999 | Zhou |

(Continued)

FOREIGN PATENT DOCUMENTS

DE 29803105 U1 9/1998

(Continued)

OTHER PUBLICATIONS

Thermal Management Considerations for Super Flux LEDs, Hewlett Packard, pp. 1-11.

(Continued)

*Primary Examiner*—Sandra O'Shea
*Assistant Examiner*—Mary Zettl
(74) *Attorney, Agent, or Firm*—Knobbe, Martens, Olson & Bear, LLP.

(57) ABSTRACT

A lighting apparatus is provided including an array of light emitting diodes (LEDs) disposed on a base. The base is configured to move heat away from the array of LEDs to other portions of the base and further to the atmosphere or an adjacent housing. In one embodiment, a native oxide on the base electrically insulates the base from the LEDs. In another embodiment, a cover is removably disposed over the array of LEDs, and removal of the cover prevents electrical energization of the LEDs.

35 Claims, 14 Drawing Sheets

U.S. PATENT DOCUMENTS 5,958,572 A 9/1999 Schmidt et al.
6,045,240 A 4/2000 Hochstein
6,056,420 A 5/2000 Wilson et al.
6,075,701 A 6/2000 Ali et al.
6,131,651 A 10/2000 Richey, III
6,249,267 B1 6/2001 Ishihara
6,250,774 B1 6/2001 Begemann et al.
6,283,612 B1 9/2001 Hunter
6,335,548 B1 * 1/2002 Roberts et al. ..... 257/98
6,350,039 B1 2/2002 Lee
6,394,626 B1 5/2002 McColloch
6,396,466 B1 5/2002 Pross et al.
6,428,189 B1 8/2002 Hochstein
6,455,930 B1 9/2002 Palanisamy et al.
6,460,598 B1 10/2002 Adams et al.
6,481,874 B2 11/2002 Petroski
6,485,160 B1 11/2002 Sommers et al.
D468,035 S 12/2002 Blanc et al.
6,503,626 B1 1/2003 Norley
6,505,956 B1 1/2003 Priddy et al.
6,509,840 B2 1/2003 Martineau
6,514,616 B1 2/2003 Gandi et al.
6,517,218 B2 2/2003 Hochstein
6,518,502 B2 2/2003 Hammond et al.
6,528,954 B1 3/2003 Lys et al.
6,548,967 B1 4/2003 Dowling et al.
6,566,824 B2 5/2003 Panagotacos et al.
6,573,536 B1 6/2003 Dry
6,578,986 B2 6/2003 Swaris et al.
6,582,100 B1 6/2003 Hochstein et al.
6,616,299 B2 9/2003 Martineau
6,642,666 B1 11/2003 St-Germain
6,659,622 B2 12/2003 Katogi et al.
6,712,486 B1 3/2004 Popovich et al.
6,713,862 B2 3/2004 Palanisamy et al.
6,720,859 B2 4/2004 Mazzochette
6,731,222 B2 5/2004 Martineau
6,739,047 B2 5/2004 Hammond et al.
6,758,573 B1 7/2004 Thomas et al.
6,765,237 B1 7/2004 Doxsee et al.
6,787,999 B2 9/2004 Stimac
6,796,698 B2 9/2004 Sommers et al.
6,799,864 B2 10/2004 Bohler et al.
6,815,724 B2 11/2004 Dry
6,846,093 B2 1/2005 Swaris et al.
6,871,983 B2 3/2005 Jacob et al.
7,102,172 B2 9/2006 Lynch et al.
7,108,396 B2 9/2006 Swaris et al.
7,114,831 B2 10/2006 Popovich et al.
2002/0114155 A1 * 8/2002 Katogi et al. ..... 362/219
2003/0024120 A1 2/2003 Adams et al.
2003/0063463 A1 4/2003 Sloan et al.
2003/0174517 A1 * 9/2003 Kiraly et al. ..... 362/555
2004/0041757 A1 * 3/2004 Yang et al. ..... 345/82
2004/0042212 A1 3/2004 Du et al.
2004/0212998 A1 * 10/2004 Mohacsi ..... 362/294
2005/0128751 A1 6/2005 Roberge
2005/0243552 A1 11/2005 Maxik

FOREIGN PATENT DOCUMENTS

EP 0 331 224 9/1989
EP 0921568 A2 6/1999
EP 1479286 11/2004
JP 2003064026 A * 3/2003
WO WO 97/37385 10/1997
WO WO2004/021461 3/2004
WO WO 2004021461 A2 * 3/2004
WO WO2005/004202 A 1/2005

OTHER PUBLICATIONS

Thermagon Catalog.
Osram Opto Semiconductors, GmbH, Rainer Huber, "Thermal Management of Golden Dragon LED", Application Note, Aug. 7, 2002.
Osram Opto Semiconductors, GmbH, Timothy Dunn, "Driving the Golden Dragon LED", Application Note, Feb. 2, 2005.
LumiLeds Lighting Publication No. DS17, LED Rail System Data Sheet, HLCR-SS99-X1X00.
Petroski, James, "Thermal Challenges Facing New Generation LEDs for Lighting Applications," in solid State Lighting II, Proceeding of SPIE vol. 4776 (2002).

* cited by examiner 40
80
122
120
84
86
82
104
100
110
106
102

6
90
94
104
84
40
86
8
8
110
100
94
92
6

90
104
40
94
120
106
122
102
80
82
114
112
100
7
94
92
7

40
110
122
114
120
112
100
106
94
104
102
82
80
92

LIGHTING APPARATUS

RELATED APPLICATIONS

This application is based on and claims priority to U.S. provisional application Ser. No. 60/505,267, which was filed on Sep. 22, 2003 and U.S. provisional application Ser. No. 60/546,273, which was filed on Feb. 20, 2004. The entirety of each of the above-referenced applications is hereby incorporated by reference.

BACKGROUND OF THE INVENTION

1. Field of the Invention

The present invention relates to light emitting diode (LED) lighting devices and more particularly to LED lighting modules having heat transfer properties that improve the efficiency and performance of LEDs.

2. Description of the Related Art

Most lighting applications utilize incandescent or gas-filled bulbs, particularly lighting applications that require more than a low level of illumination. Such bulbs typically do not have long operating lifetimes and thus require frequent replacement. Gas-filled tubes, such as fluorescent or neon tubes, may have longer lifetimes, but operate using dangerously high voltages and are relatively expensive. Further, both bulbs and gas-filled tubes consume substantial amounts of power.

In contrast, light emitting diodes (LEDs) are relatively inexpensive, operate at low voltage, and have long operating lifetimes. Additionally, LEDs consume relatively little power and are relatively compact. These attributes make LEDs particularly desirable and well suited for many applications.

Although it is known that the brightness of the light emitted by an LED can be increased by increasing the electrical current supplied to the LED, increased current also increases the junction temperature of the LED. Increased junction temperature may reduce the efficiency and the lifetime of the LED. For example, it has been noted that for every 10° C. increase in temperature above a specified temperature, the operating lifetime of silicone and gallium arsenide drops by a factor of 2.5-3. LEDs are often constructed of semiconductor materials that share many similar properties with silicone and gallium arsenide.

Accordingly, there is a need for an apparatus to efficiently remove heat from LEDs in order to decrease the junction temperature during use and thereby increase the operating lifetime of the LEDs.

SUMMARY OF THE INVENTION

In accordance with one embodiment, a lighting apparatus is provided comprising a base comprised of an electrically conductive material and a layer of oxide on the material. An array of LEDs is mounted on the base. The LEDs are electrically insulated from the conductive material by the oxide. In another embodiment, the base includes electrically conductive traces disposed on the oxide, which traces interconnect the LEDs in the array.

In accordance with a further embodiment, a lighting apparatus is provided comprising a base, an array of LEDs mounted to the base, and a cover configured to cover the array. Power is supplied to the LEDs via an electrical pathway. The cover is mechanically coupled to the base such that attachment of the cover completes the electrical pathway to permit power to flow to the LEDs, and removal of the cover opens the electrical pathway to prevent flow of power.

In accordance with a still further embodiment, the lighting apparatus additionally comprises a power supply having first and second power supply nodes. The base and cover are attachable to the power supply so that the first and second nodes electrically communicate with the cover to complete the electrical pathway.

In accordance with another embodiment, a lighting apparatus is provided comprising a base, an array of LEDs mounted on the base, and a cover comprising a sheet that covers the array of LEDs and receives light from the LEDs. The sheet is comprised of a phosphor which emits light in response to optical pumping by the LEDs.

In a further embodiment, the base comprises a cavity, the array of LEDs is arranged in the cavity, and the cover is configured to completely enclose the cavity when the cover is in place so that substantially no light emitted by the LEDs exits the cavity without first contacting the cover.

In still another embodiment, the sheet comprises more than one layer. In yet another embodiment, the cover comprises glass, and the phosphor is mixed with the glass. In further embodiments, the sheet consists of inorganic material, and the LEDs emit ultraviolet light.

For purposes of summarizing the invention and the advantages achieved over the prior art, certain aspects of embodiments have been described herein above. Of course, it is to be understood that not necessarily all such aspects may be achieved in accordance with any particular embodiment of the invention. Thus, for example, those skilled in the art will recognize that the invention may be embodied or carried out in a manner that achieves or optimizes one aspect or group of aspects as taught herein without necessarily achieving other aspects as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
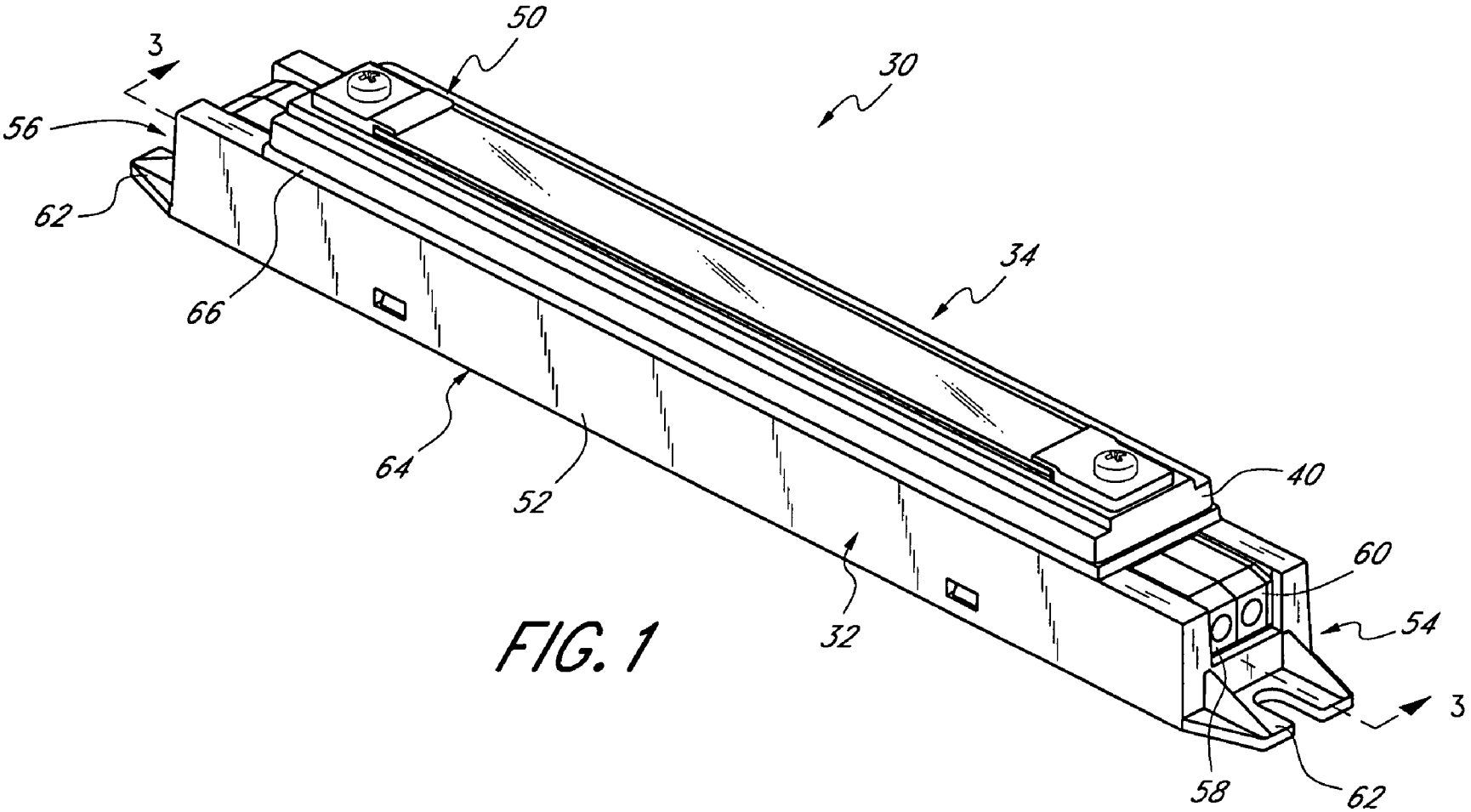
FIG. 1 is a perspective view of a lighting apparatus having features in accordance with an embodiment of the present invention.
Figure 2:
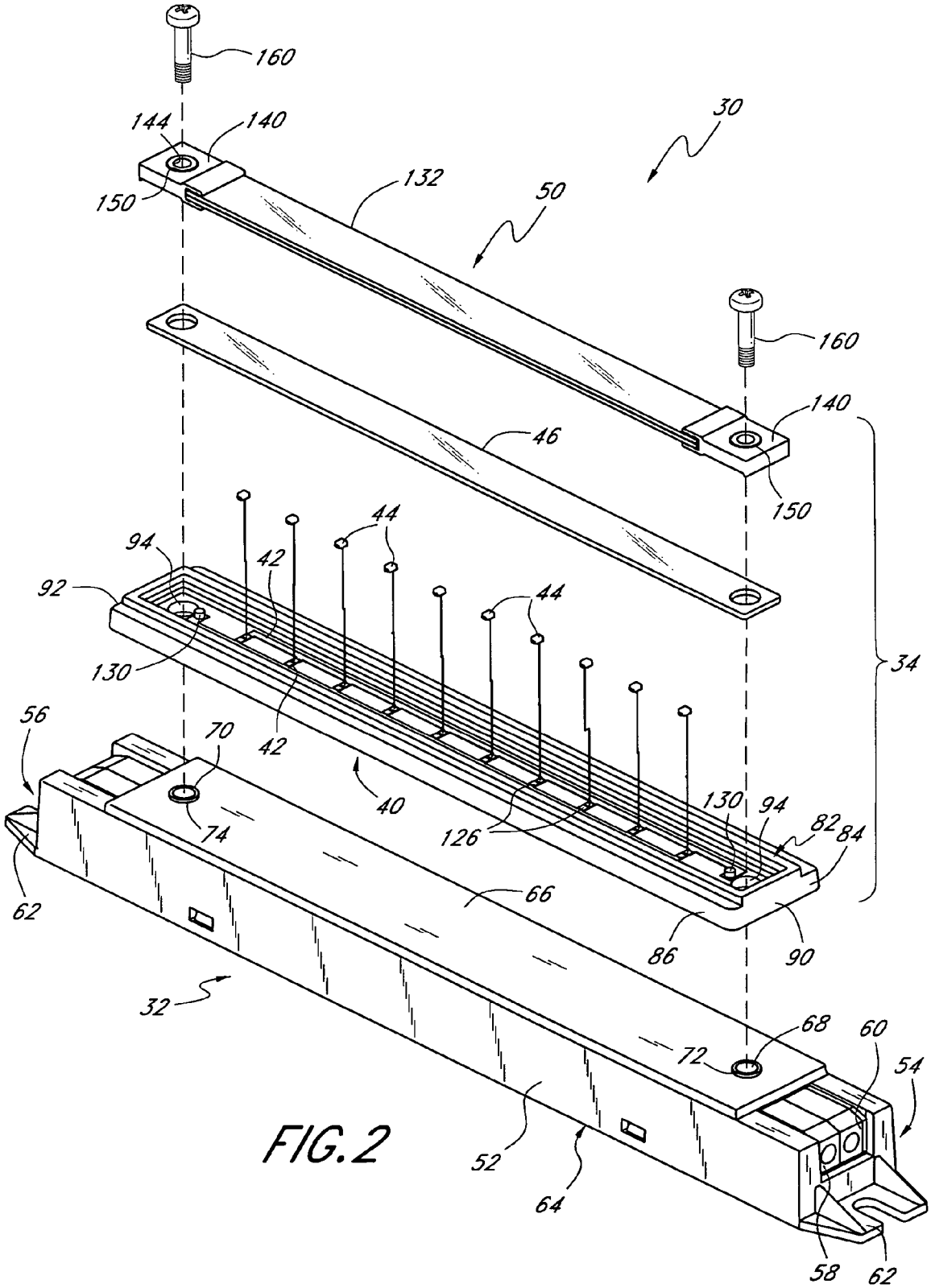
FIG. 2 is an exploded view of the lighting apparatus of FIG. 1.
Figure 3:
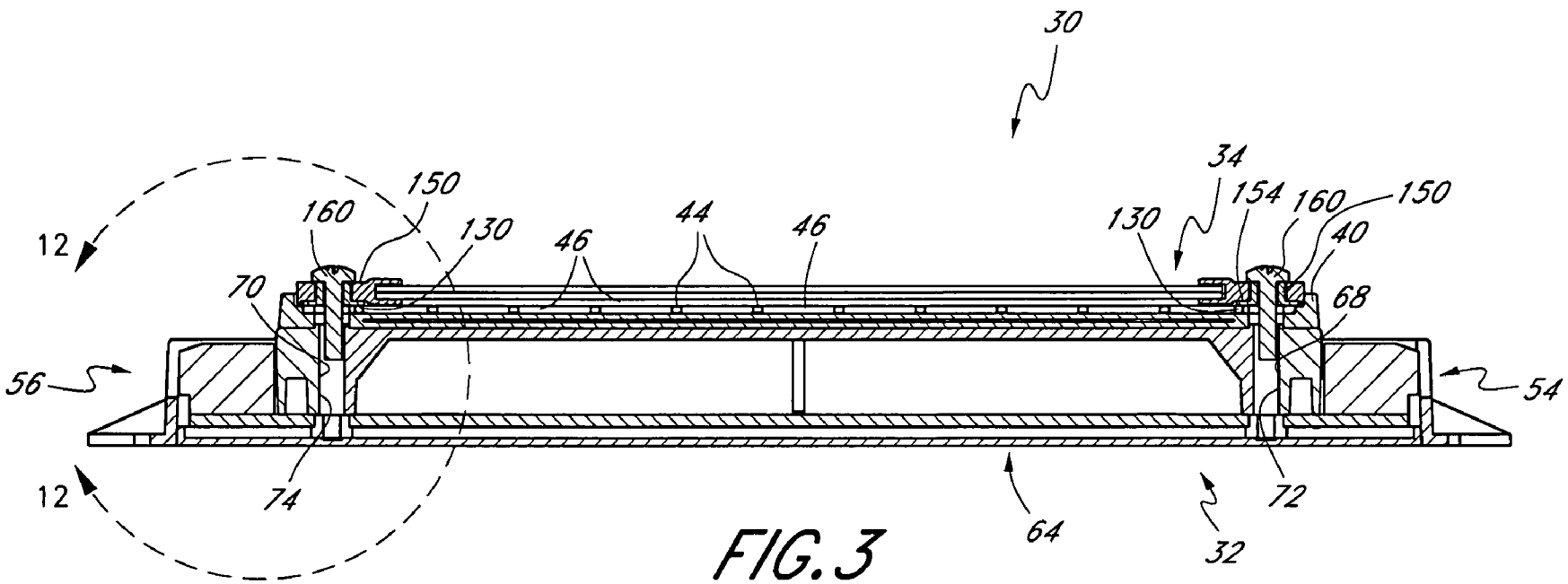
FIG. 3 is a cross-sectional view showing the apparatus of FIG. 1 taken along lines 3-3.
Figure 4:
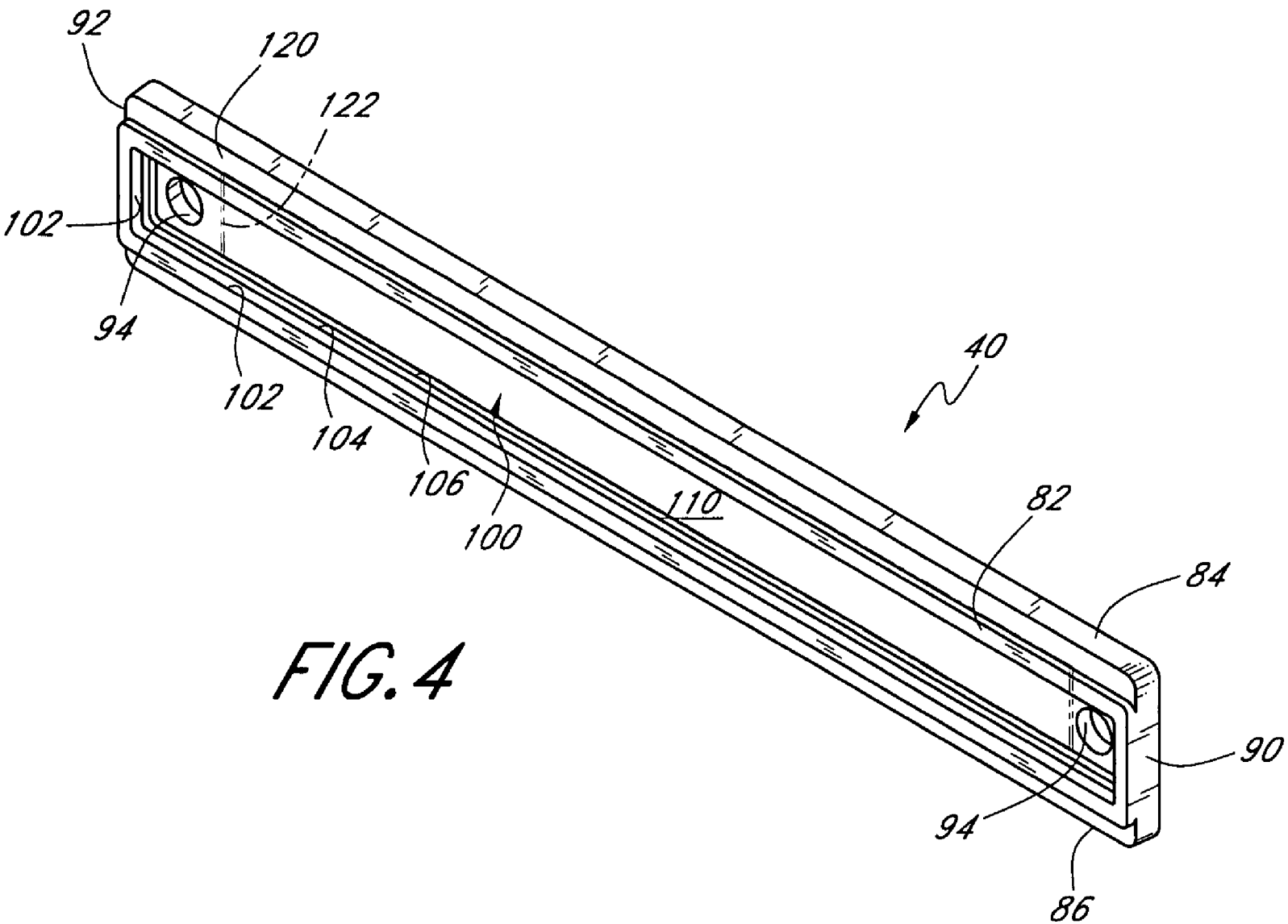
FIG. 4 is a perspective view of an embodiment of a base portion.
Figures 5, 6, 7, 8:
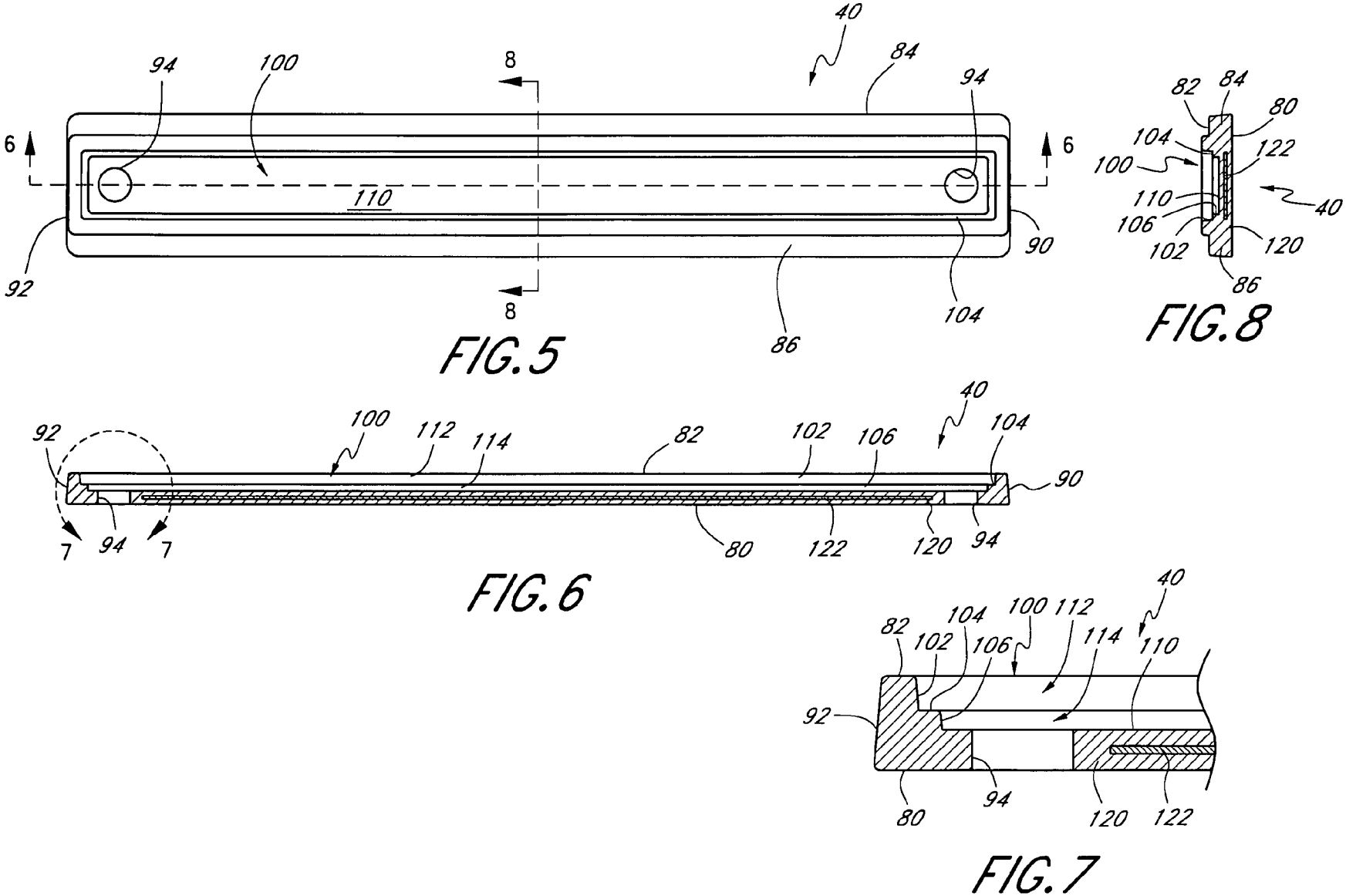
FIG. 5 is a top view of the base portion of FIG. 4.
FIG. 6 is a cross-sectional view taken along lines 6-6 of FIG. 5.
FIG. 7 is a close-up view taken along lines 7-7 of FIG. 6.
FIG. 8 is a cross-sectional view taken along lines 8-8 of FIG. 5.
Figure 9:
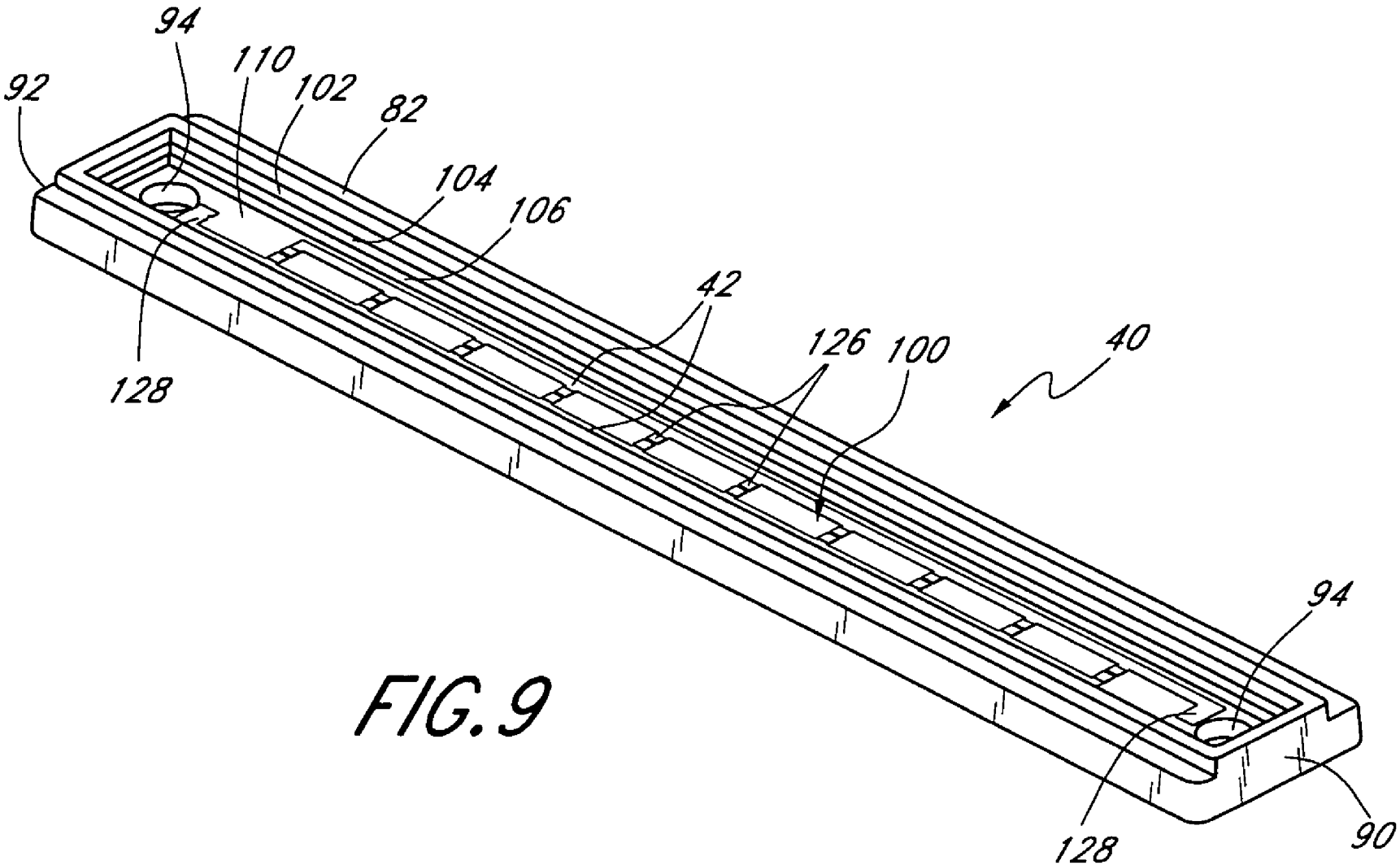
FIG. 9 shows an embodiment of a base portion having circuit traces disposed thereon.
Figure 10:
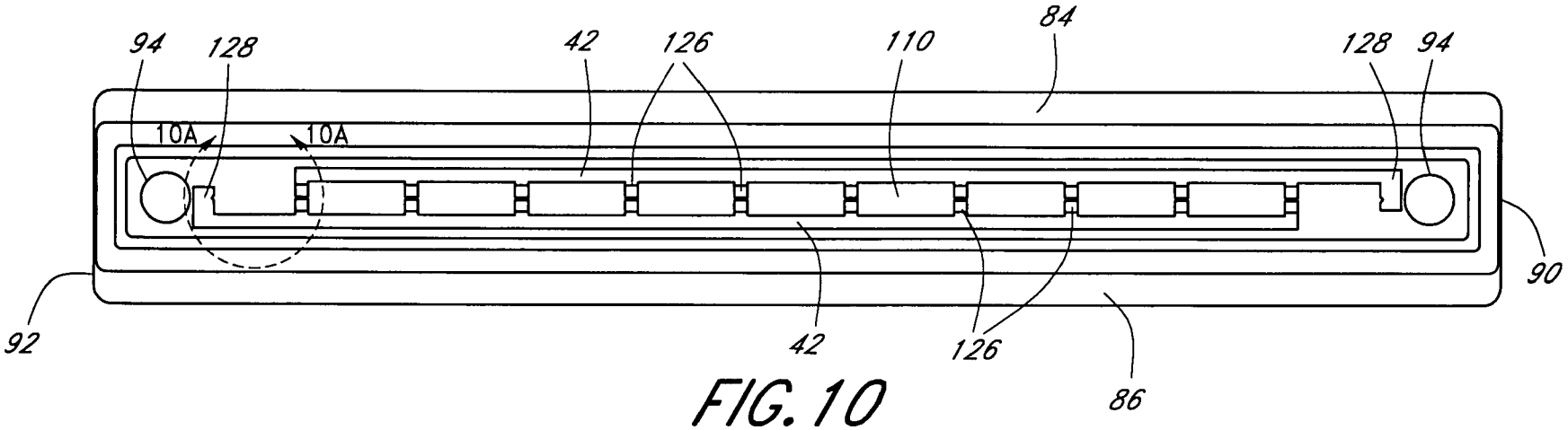
FIG. 10 is a top view of the base portion of FIG. 9 showing the circuit traces.
Figure 11:
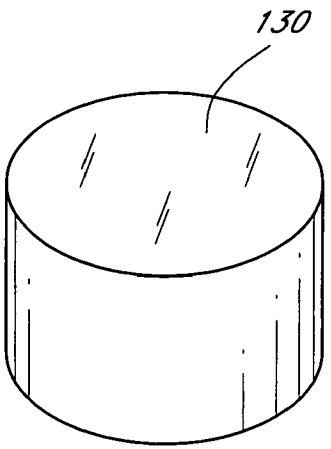
FIG. 11 shows an embodiment of a member.
Figure 10A:
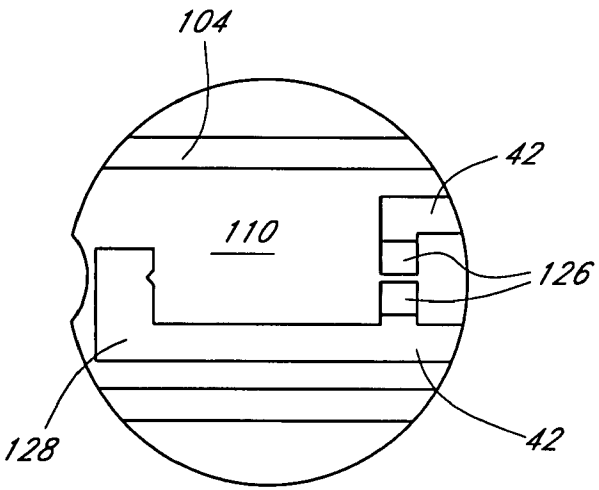
FIG. 10A is a close up view of a portion of FIG. 10 taken along lines 10A-10A.

With initial reference to FIGS. 1-3, an embodiment of a lighting apparatus 30 is illustrated. The lighting apparatus 30 preferably comprises a power module 32 and a light emitting diode (LED) module 34 that are connected to one another. In summary, the LED module 34 comprises a heat conductive base 40 upon which a plurality of electrically conductive traces 42 are disposed. An array of LEDs 44 is mounted on the base 40 and electrically connected to the traces 42. Transmissive material 46 is disposed in and around the LEDs 44, and a cover 50 is placed thereover. The cover 50 preferably comprises a phosphor.

With continued reference to FIGS. 1-3, the power module 34 comprises an elongate body 52 having a first end 54 and a second end 56. Each of the first and second ends 54, 56 include positive and negative connectors 58, 60 that are adapted to connect to flexible conductors such as electrical wire. Further, the first and second ends 54, 56 each include a mounting flange 62 adapted to receive a fastener in order to secure the lighting apparatus 30 to a mount surface. In other embodiments, other mounting structures and methods can be employed. For example, two-sided tape can be disposed on a bottom surface 64 of the power module 32 in order to secure the apparatus to a mount surface.

The power module 32 preferably is configured to be powered by an external power supply and receives constant input voltage of about 12 or 24 volts DC. Preferably, the power module 32 converts the constant input voltage into a constant current for electrically driving the LEDs 44 of the LED module 34. The current preferably is pulsed with a frequency in excess of about 300 Hz. A power module 32 exhibiting such electrical behavior can be obtained from Advance Transformer/Phillips.

With specific reference to FIG. 2, the illustrated power module 32 has a generally flat mount surface 66 configured to engage and support the LED module 34. First and second mount holes 68, 70 facilitate mounting of the LED module 34 to the power module 32. Power is supplied from the power module 32 to the LED module 34 between an input node 72 and an output node 74. In the illustrated embodiment, the input and output nodes 72, 74 are disposed at or in the first and second mount holes 68, 70.

With reference also to FIGS. 4-8, the base 40 preferably has a bottom surface 80, a top surface 82, first and second sides 84, 86, and first and second ends 90, 92. Mount holes 94, 96 are disposed adjacent the first and second ends 90, 92, respectively, and are configured to align with the mount holes 68, 70 in the power module 32. The top surface 82 preferably has a cavity 100 formed therein. An upper wall 102 extends from the top surface 82 to a step 104. A lower wall 106 extends from the step 104 to a cavity surface 110. The portion of the cavity 100 defined within the upper wall 102 and step 104 is referred to as an upper cavity 112; the portion of the cavity 100 defined within the lower wall 106 between the step 104 and the cavity surface 110 is referred to as a lower cavity 114.

With continued reference specifically to FIGS. 4-8, the base 40 comprises a first portion 120 and a second portion 122. The majority of the volume of the base 40 comprises the first portion 120, which preferably is constructed of a heat conductive material, such as a metal or metal alloy. In the illustrated embodiment, the first portion 120 comprises an aluminum silicon carbon (AlSiC) material. It is to be understood that, in other embodiments, the first portion can be made of other heat conductive materials, and even a combination of two or more different heat conductive materials.

The second portion 122 of the base 40 preferably comprises a relatively thin sheet of another heat conductive material. In some embodiments, the sheet is referred to as a heat conductive insert. A coefficient of thermal conductivity of the second portion 122 is greater than a coefficient of thermal conductivity of any part of the first portion 120. In the illustrated embodiment, the second portion 122 is centered just below the cavity 100 and is enclosed within the base 40. Heat from within the lower cavity 114 is drawn into the first portion 120 and flows readily to the second portion 122. Due to its high heat conductance properties, the second portion 122 distributes heat received from the lower cavity away from the lower cavity and to other locations within the first portion 120, specifically to the first and second sides 84, 86 which, in the illustrated embodiment, are part of the first portion 120. From the sides 84, 86, the heat is radiated away from the base 40 to the atmosphere or an adjacent heat sink.

The second portion 122 preferably comprises a relatively thin generally planar sheet comprising a material having not only high thermal conductivity, but also having directional thermal conductivity properties. For example, preferably the flat sheet of the second portion 122 conducts heat in a plane generally parallel to a center plane of the flat sheet of material. In the illustrated embodiment, the second portion 122 comprises strands of material that preferentially conduct heat along the length of the strand. The strands preferably are oriented to direct heat toward the first and second sides 84, 86 of the second portion. Further, in the illustrated embodiment the second portion 122 comprises carbon strands and, more specifically, highly-oriented pyrolytic graphite. Most preferably, the second portion has a very high thermal conductivity, such as greater than about 1,000 W/(m*K) or, in another embodiment, at least about 1,350-1,450 W/(m*K).

A base member having properties as discussed above in connection with the illustrated embodiment can be obtained from Ceramics Process Systems Corporation of Chartly, Mass.

In other embodiments, the second portion comprises a relatively thin sheet that is made of a material having a high thermal conductivity but which does not necessarily preferentially conduct heat in a plane generally parallel to a center plane of the second portion. In further embodiments, the second portion may vary in size, shape and layout. For example, in one embodiment, the second portion has a pyramid-shaped cross-section and is disposed beneath the cavity surface 110.

In the illustrated embodiment, the second portion 122 is disposed generally in the center of the base 40, and is substantially enclosed within the first portion 120. It is to be understood that, in other embodiments, the second portion can extend further from the center into the first and second sides, and can even extend out of at least one of the sides of the base. In yet further embodiments, the first portion may include fins to radiate heat to the atmosphere surrounding the first portion.

As discussed above, the base 40 preferably is made of a heat conductive material. In the illustrated embodiment, the base comprises AlSiC, which is also electrically conductive. In accordance with a preferred embodiment, the electrically conductive base comprises a layer of oxide disposed thereon. Preferably, the oxide is a native oxide of the electrically conductive material of which the base is made. Further, the oxide layer preferably has a thickness of about 2 mils or less. In one embodiment, a native oxide layer is grown on the conductive base 40 via an anodization process. More particularly, the base preferably is anodized in an electrochemical bath in order to grow the native oxide thereon. It is to be understood that, in other embodiments, other methods and apparatus can be used to deposit a non-conductive layer on the base. For example, powder coating or plating with any non-electrically-conductive electroless metal can be acceptable.

In the illustrated embodiment, the native oxide grown through anodization functions as a dielectric to electrically insulate the base 40. With next reference to FIGS. 2, 9, 10 and 10*a*, electrically conductive circuit traces 42 preferably are disposed on the cavity surface 110 of the base 40, and are attached to the oxide layer. As such, the electrical traces 42 are electrically insulated from the base 40 by the oxide layer. The electrically conductive traces 42 are arranged to provide an electrical pathway to power a plurality of LEDs 44 attached to the traces. Contact pads 126 of the traces 42 are configured to accept LEDs mounted thereon. In the illustrated embodiment, the contact pads 126 are thicker than other portions of the traces 42.

In the illustrated embodiment, the electrical circuit traces 42 are configured to mount ten LEDs 44 in an electrically parallel fashion. It is to be understood that, in other embodiments, any desired number of LEDs can be used, and different electrical arrangements can be employed. For example, the LEDs can be arranged electrically in series. Also, more than one set of serially-connected LEDs can be arranged so that the sets are electrically in parallel relative to one another within the cavity 100. Further, the LEDs can be disposed in different mechanical arrangements. For example, in the illustrated embodiment, the ten LEDs 44 are equally spaced and arranged in a serial array. It is to be understood that other spacings and arrangements can be accomplished as desired.

In the illustrated embodiment, the circuit traces 42 comprise an electrically conductive material such as aluminum or another metal laid upon the oxide layer of the base 40. The base 40 is electrically insulated from the power traces 42 by the non-conductive oxide layer. The power traces 42 are laid on the oxide layer by any suitable method, including methods currently employed by vendors such as Kyocera and IJ Research.

With next reference to FIGS. 3 and 9-12, the power traces 42 have terminus portions 128 disposed adjacent the mount holes 94, 96 at either end of the base 40. A conductive contact member 130 preferably is electrically connected at each terminus 128 and extends upwardly from the power traces 42. Preferably the contact member 130 extends upwardly up to or beyond the level of the step 104 between the upper and lower walls 102, 106 in the cavity 100. Preferably, the contact member 130 is bonded, co-formed, or otherwise attached to the respective terminus portion 128. For example, in one embodiment, the contact member 130 is soldered in place on the terminus portion 128. In the illustrated embodiment, the contact member 130 comprises a cylindrical pin. It is to be understood that, in other embodiments, other shapes and sizes of contact members can be employed.

Figure 12:
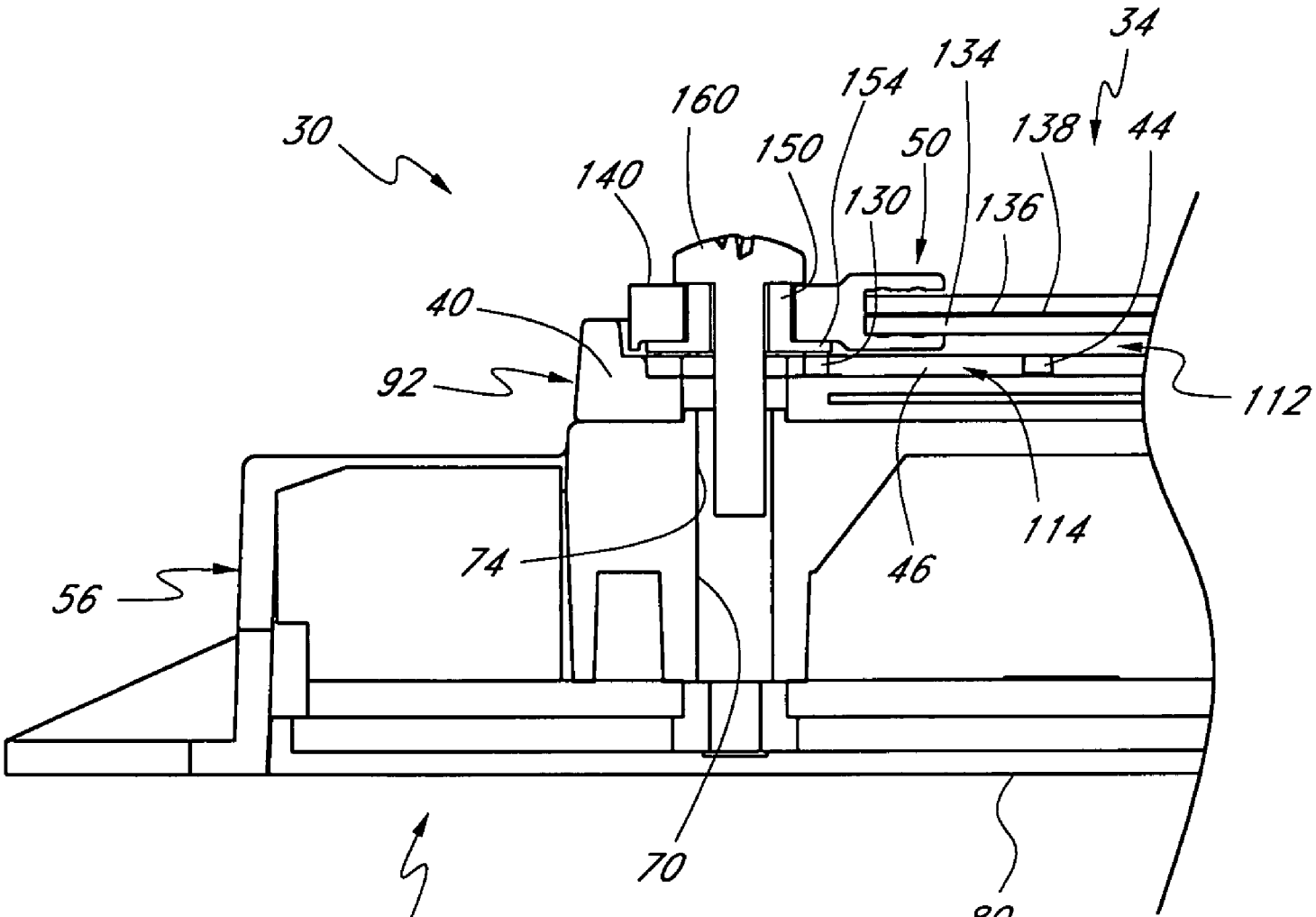
FIG. 12 is a close-up of a portion of a lighting apparatus taken along lines 12-12 of FIG. 3.
Figure 14:
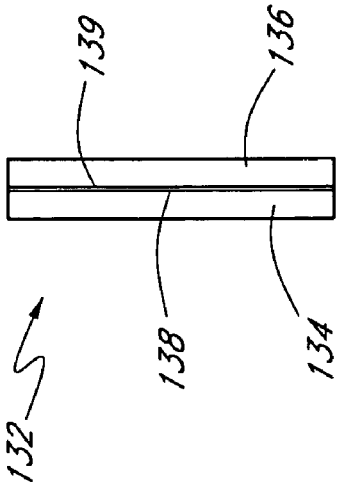
FIG. 14 is an end view of the cover sheet of FIG. 13, showing layers.
Figure 13:
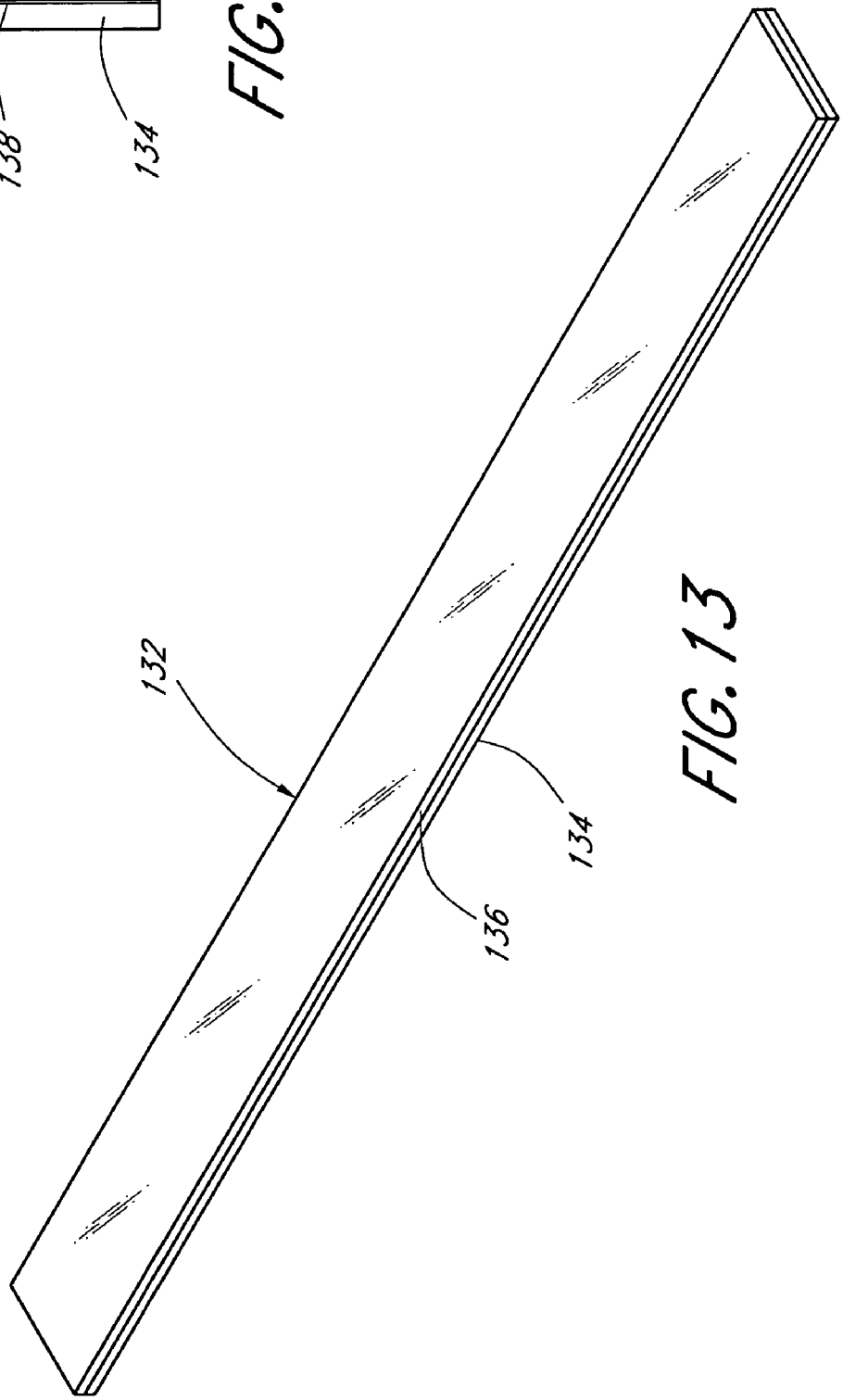
FIG. 13 shows a perspective view of a cover sheet.
Figure 15B:
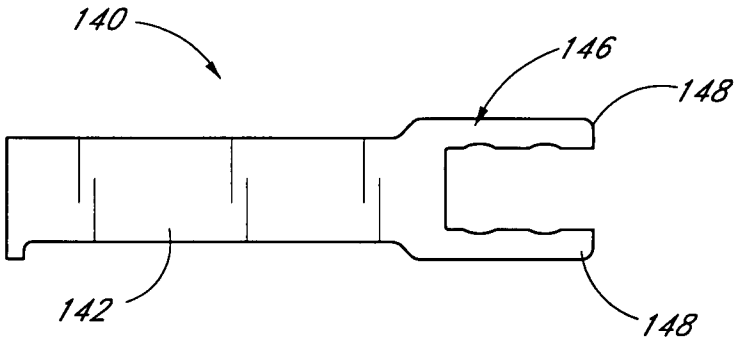
FIG. 15B is a side view of the cover frame of FIG. 15A.
Figure 15C:
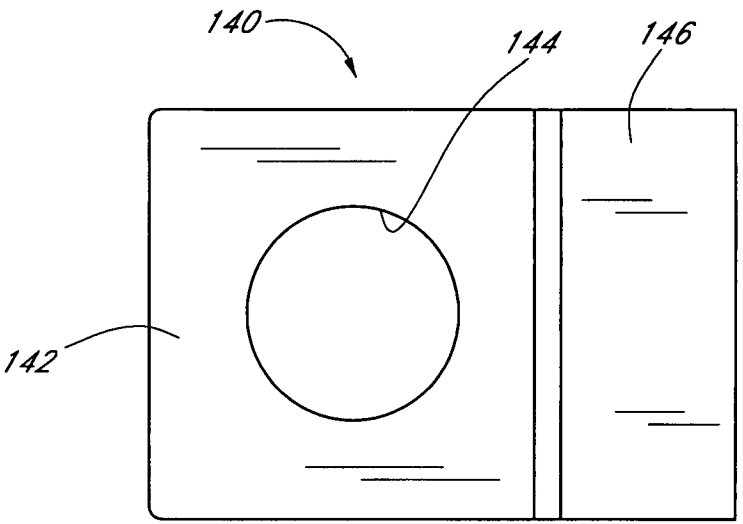
FIG. 15C is a top view of the cover frame of FIG. 15A.
Figure 15A:
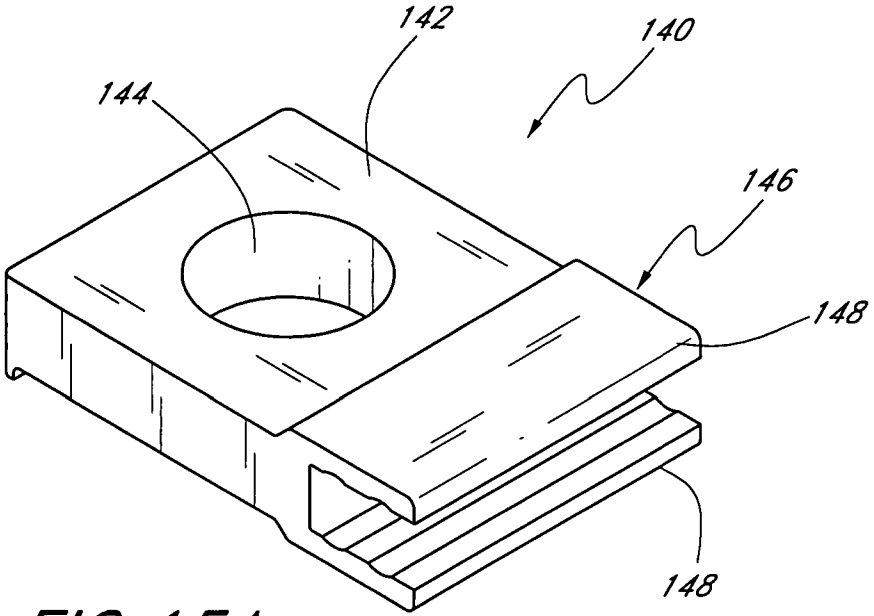
FIG. 15A is a perspective view of a cover frame.
Figure 16B:
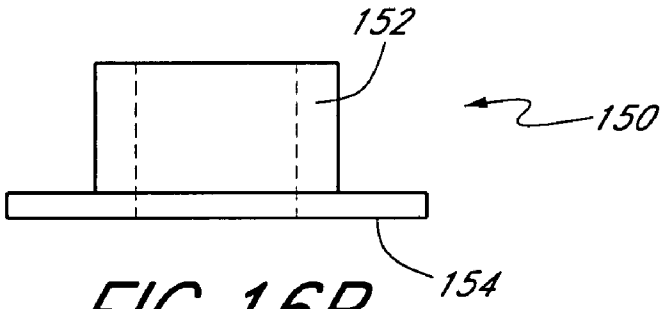
FIG. 16B is a side view of the contact sleeve of FIG. 16A.
Figure 16C:
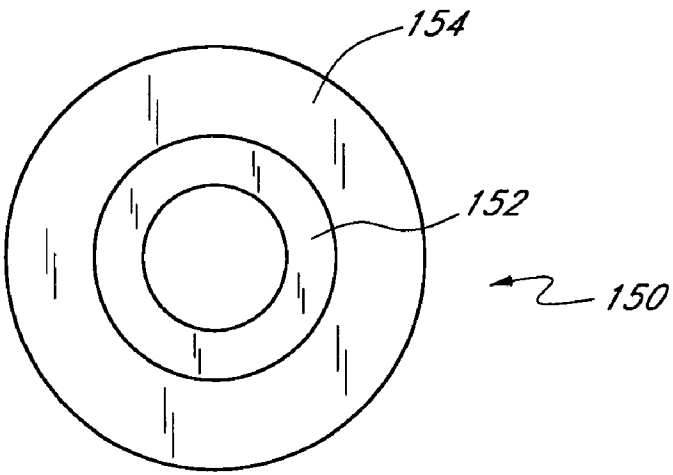
FIG. 16C is a top view of the contact sleeve of FIG. 16A.
Figure 16A:
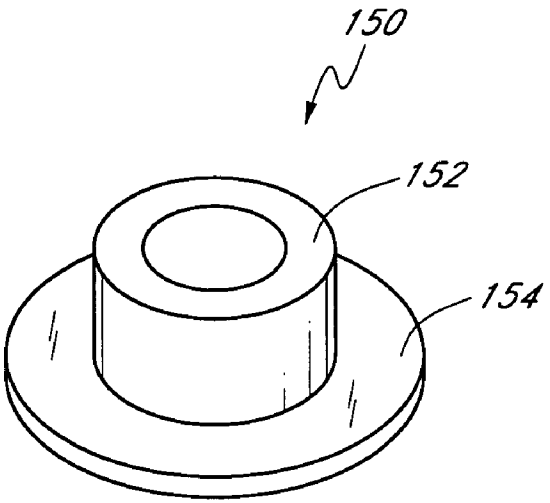
FIG. 16A is a perspective view of a contact sleeve.

With reference next to FIGS. 2, 3 and 12, the lower cavity 114 preferably is filled with a transmissive material 46. In the illustrated embodiment the transmissive material 46 comprises a mixture of silicone and glass. In One embodiment, the transmissive material 46 is chosen from materials known as sol-gels. In another embodiment, the transmissive material 46 comprises a mixture of silicone and glass available under the trademark Sogel™, which can be obtained from WaveGuide.

The cover 50 is configured to be disposed over the cavity 100 of the base 40 so as to cover the array of LEDs 44 and receive light from the LEDs. In the illustrated embodiment and with reference specifically to FIGS. 2, 3 and 12-14, the cover 50 preferably comprises a multi-layer sheet 132. The sheet 132 comprises first and second layers 134, 136 of glass that sandwich a layer of phosphor 138. The glass and phosphor layers 134, 136, 138 preferably are connected by a layer of adhesive 139.

In the illustrated embodiment, the phosphor 138 is sandwiched between two layers of glass 134, 136. In another embodiment the phosphor is mixed, embedded and/or suspended in the glass so that the sheet comprises only a single layer of phosphor-including glass. In a preferred embodiment, the sheet comprises inorganic material that will not degrade when exposed to ultraviolet light. Further, in such an embodiment, the LEDs are configured to emit ultraviolet light. In further embodiments, the cover 50 sheet can be colored or include one or more colored layers, and may or may not include a phosphor.

Continuing with reference to FIGS. 2, 3 and 12-16, the sheet 132 of the cover 50 preferably is held on either end by a cover frame 140. With particular reference to FIGS. 15A-C, each cover frame 140 preferably includes a body 142 having a mount hole 144 formed therethrough, which mount hole 144 is configured to align with the mount holes 144 of the base 40 and power module 32. A gripping portion 146 of the frame body 142 comprises opposing jaws 148 that are configured to hold the sheet 132.

When the cover 50 and base 40 are assembled, as shown in FIGS. 3 and 12, the cover 50 is configured to fit at least partially within the upper wall 102 in the upper portion 112 of the base cavity 100. Preferably, the cover 50 fits generally snugly in the upper portion 112 so that substantially no light emitted by the LEDs 44 exits the cavity 100 without first contacting the cover 50. In another embodiment, the cover 50 generally engages the step 104 so as to substantially enclose the lower portion 114 of the cavity 100.

In the illustrated embodiment, the transmissive material 46 is deposited in the cavity 100 so as to surround the LEDs 44. As the cover 50 is placed in the cavity 100, excess transmissive material 46 will squeeze past the cover 50 and can be removed from the device. As such, the sheet 132 preferably abuts the transmissive material 46 and/or the LEDs 44 so that there is very little or substantially no air between the LEDs 44 and the cover sheet 132.

In the illustrated embodiment the transmissive material 46, LEDs 44, and sheet 132 comprise a graduated refractive index. More specifically, in the illustrated embodiment the LEDs 44 each preferably have a refractive index of between about 2.1 to 2.8. The transmissive material 46 preferably has a refractive index between about 1.5 to 1.8. A first layer of glass 134 in the sheet preferably has a refractive index between about 1.45 to 1.5. A second layer of glass 136 in the sheet preferably has a refractive index of about 1.40 to 1.45. As such, the several different layers of materials collectively comprise a graduated refractive index, and the refractive indices of the layers are relatively closely matched so as to maximize light output from the apparatus 30. In embodiments wherein the cover 50 comprises a phosphor 138, light from the LEDs 44 is absorbed by the phosphor, which emits light in response to such optical pumping by the LEDs.

With reference particularly to FIGS. 12 and 16A-C, a contact sleeve 150 preferably is disposed in each cover frame hole 144. The contact sleeve 150 preferably is made of a conductive material such as a metal. In the illustrated embodiment, the contact sleeve 150 comprises an elongate body portion 152 that is configured to fit through the cover frame hole 144, and a flange portion 154 that extends radially outwardly from the body portion 152. With particular reference to FIGS. 3 and 12, the contact sleeve 150 is fit within the cover frame 140 and the cover 50 is placed on the base 40 so that the flange portion 154 of the contact sleeve 150 contacts and engages the corresponding contact member 130. A threaded mount bolt 160 extends through each contact sleeve 150, through the base 40, and into the corresponding mount holes 68 or 70 of the power module 32. Threads within the power module mount holes 68, 70 engage the respective mount bolts 160 so that the assembly is securely held together. As discussed above, the first and second mount holes 68, 70 of the power module 32 comprise first and second electrical nodes 72, 74. As such, when engaged in the threaded mount holes 68, 70, the mount bolts 160 are electrically energized.

As best shown in FIGS. 3 and 12, and as discussed above, when the cover 50 is installed, the flange portion 154 of the contact sleeve 150 engages the contact member 130, which extends upwardly from the conductive traces 42. Thus, an electrical circuit is completed creating an electrical pathway from the first node 72 of the power supply module 32 through the first bolt 160 and contact sleeve 150 into the contact member 130 and further through the power traces 42 and LEDs 44. From the power traces 42 the electrical pathway proceeds to the second contact member 130, second contact sleeve 150, second bolt 160 and further to the second node 74. When the power module 32 is energized, current flows along this pathway to drive the LEDs 44. When the cover 50 is removed, however, there is no electrical pathway between the power supply module nodes 72, 74 and the contact members 130. In this manner, the LEDs 44 of the LED module 34 cannot be powered when the cover 50 is not in place. As such, worker safety when working with such lighting apparatus 30 is enhanced, especially when ultraviolet light-emitting LEDs are in use, because the LEDs will not be powered, and thus will not be lit, without the protective cover in place.

Although the illustrated embodiment shows the cover 50 being connected to the module 32, 34 by first and second threaded bolts 160, it should be appreciated that the mechanical connection used to complete the electrical pathway may be any mechanical or other connection known in the art. For example, other connections may include clamps, pins, screws, detents, solder, conductive adhesives, etc. Similarly, it is to be understood that other configurations of the power supply nodes may appropriately be used. Additionally, the contact sleeves and power node connections may be threaded so as to enhance the mechanical and electrical connection between the mount bolts 160, sleeve 150 and power module nodes 72, 74.

In another embodiment, at least portions of the cover frames 140 are electrically conductive and, rather than employ a contact sleeve, each cover frame 140 comprises an engagement portion shaped and configured to engage the contact member 130 when the cover 50 is secured in place on the base 40. In this embodiment, the power supply nodes preferably are configured to electrically engage the respective cover frame when the cover is in place so that an electrical pathway is established between the nodes and the contact members through the cover frames.

In still another embodiment, one of the circuit terminus portions is electrically connected to a respective power supply node through a trace configured to electrically engage the bolt without electrically contacting the cover. The other terminus portion preferably electrically engages the cover. As such, the electrical pathway between power module nodes flows through only one end of the cover.

In a further embodiment, multiple covers may be provided for a single lighting apparatus 30, each cover having different color and/or phosphor properties. As such, lighting properties of each lighting apparatus 30 can be modified by simply changing the cover 50.

Figure 17:
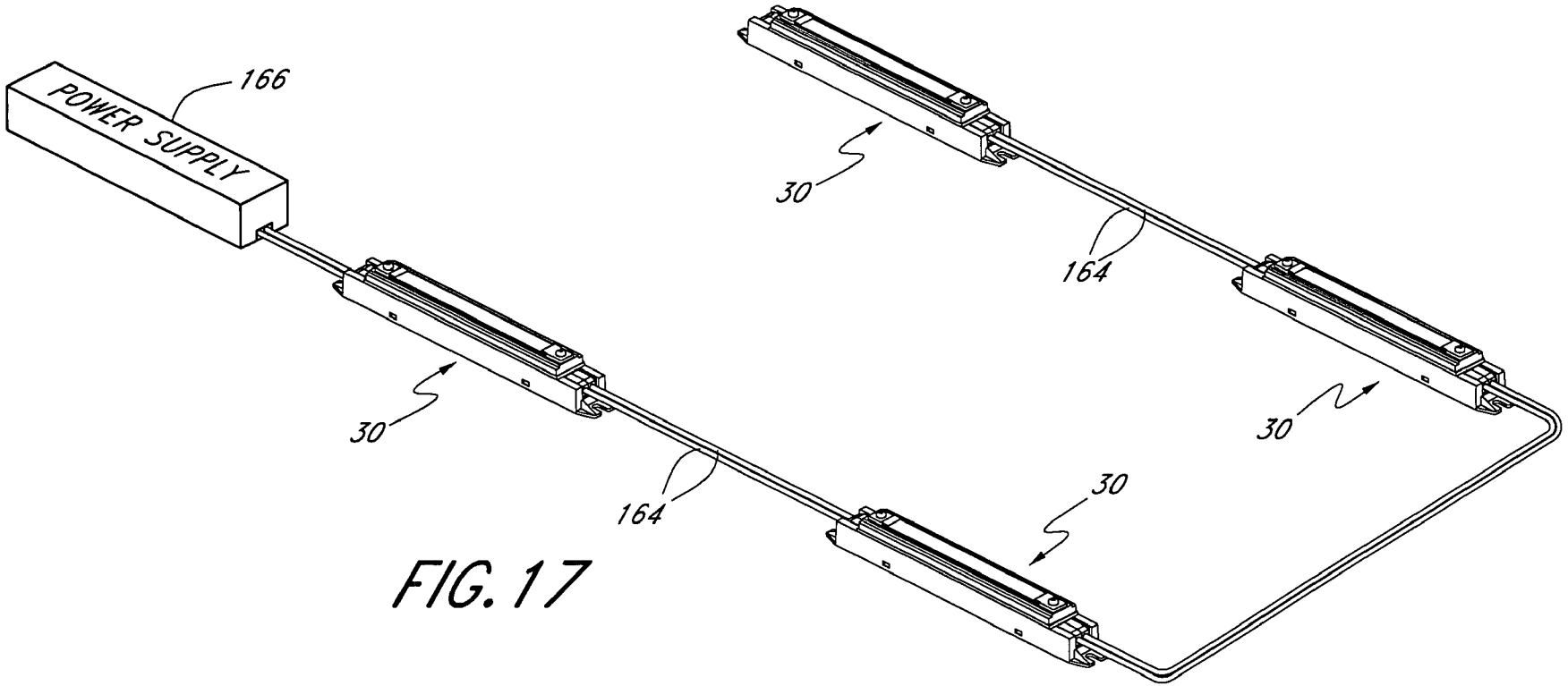
FIG. 17 shows an arrangement in which several lighting apparatuses are electrically connected to a power supply and to one another.

With reference next to FIG. 17, each lighting apparatus 30 is configured to be connected to other such lighting apparatus 30 by flexible conductors 164. A common power supply 166 is configured to supply power to the respective apparatus 30. It is to be understood that several such lighting apparatus 30 can be joined end-to-end in a daisy-chain arrangement and used for various applications. In the illustrated embodiment, the power supply modules 32 are configured so that the lighting apparatus 30 are connected electrically in parallel. In another embodiment, the modules 32 may be configured so that such a daisy-chain arrangement is electrically in series.

Figure 18:
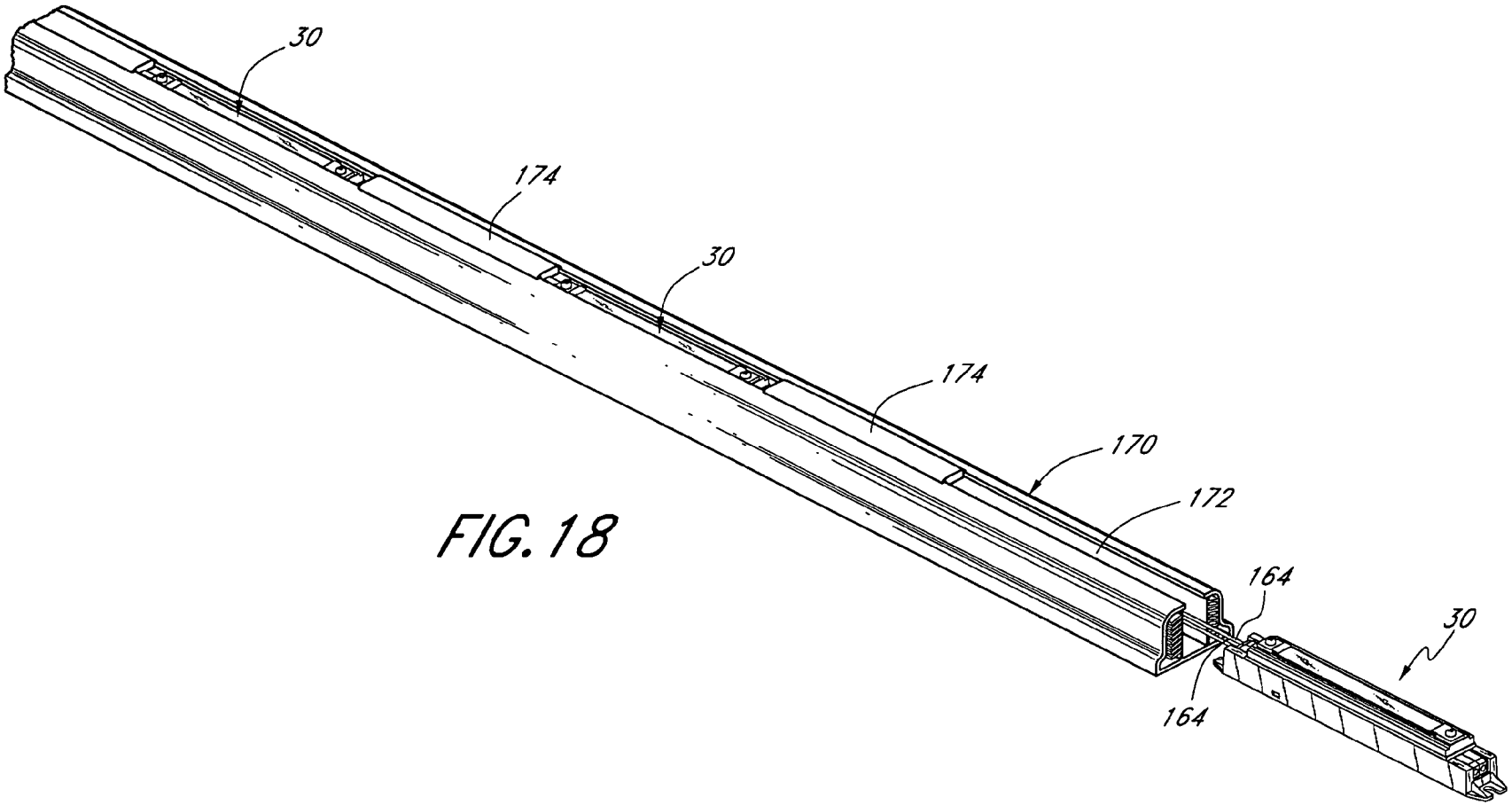
FIG. 18 shows a plurality of lighting apparatuses being fit into an embodiment of a housing.
Figure 19:
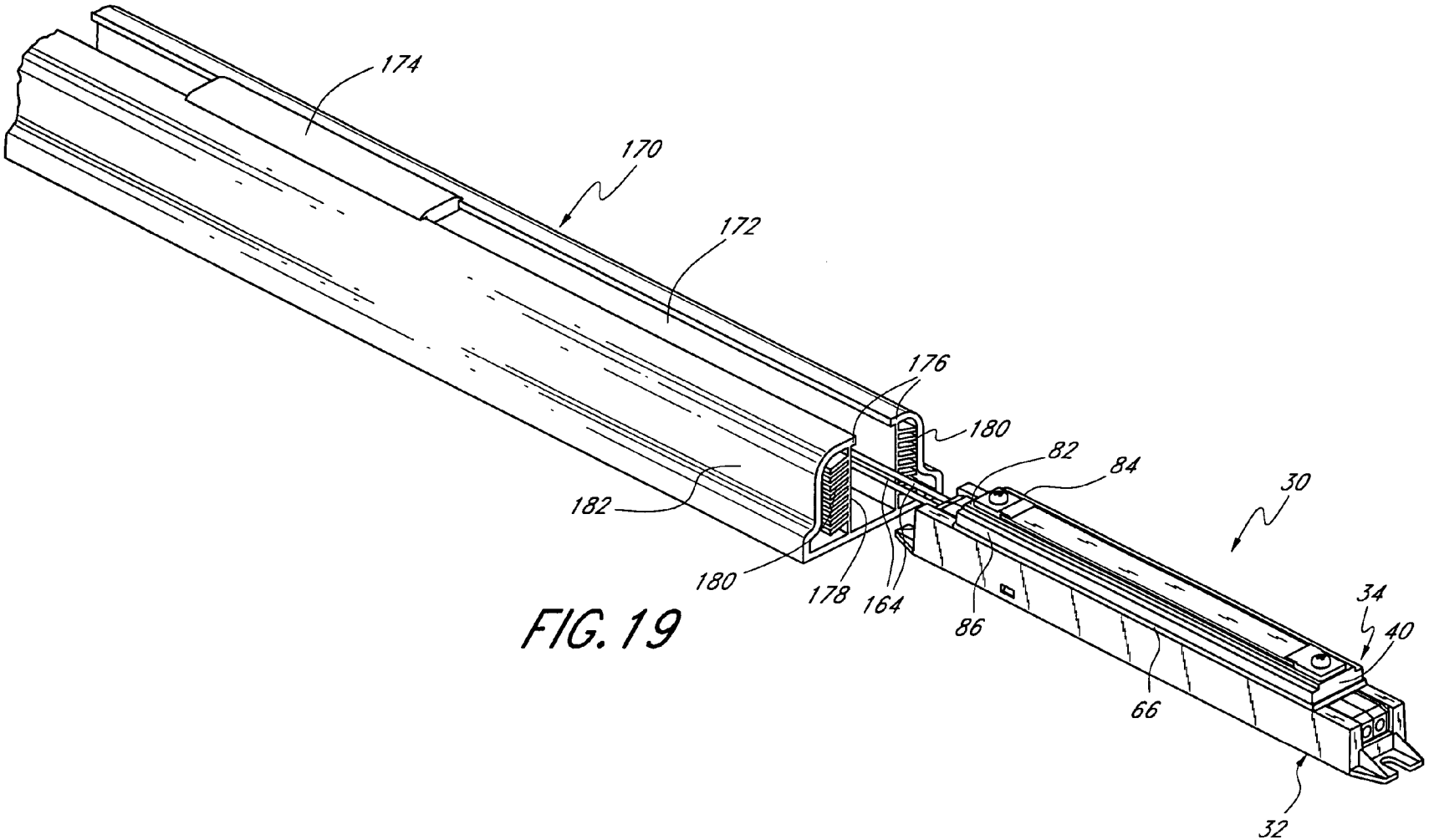
FIG. 19 is a close-up view of a lighting apparatus being fit into an embodiment of a housing.

With next reference to FIGS. 18 and 19, a housing 170 preferably comprises a channel 172 that is configured to slidably accept a plurality of lighting apparatus 30 therewithin. For aesthetic purposes, and to ensure proper spacing between connected lighting apparatus 30, a spacer 174 preferably is fit between adjacent lighting apparatus 30 within the channel 172. Preferably the housing 170 comprises a thermally conductive material such as aluminum or another metal. With particular reference to FIG. 19, upper and side walls 176, 178 of the housing channel 172 are configured to engage top and side surfaces 82, 84, 86 of the base 40 so that heat that is drawn from the LEDs 44 and directed to the sides 84, 86 of the base 40 is further conducted from the sides 84, 86 to the housing 170. Additionally, in accordance with one embodiment, the power supply mount surface 66 is heat conductive to further facilitate conduction of heat away from the base 40.

As shown in FIG. 19, the side walls 178 of the housing 172 preferably have a plurality of fins 180 so as to aid in convection and thus speed dissipation of heat. As such, heat is drawn quickly from the LEDs 44 through the base 40 and into the housing 170, from which it is radiated to the environment. In the illustrated embodiment, the second portion 122 of the base 40 facilitates such a heat pathway by quickly communicating heat generated by the LEDs 44 within the lower cavity 114 toward the sides 84, 86 of the base 40 and to the fins 180, which are adjacent the sides 84, 86.

With continued reference to FIGS. 18 and 19, in the illustrated embodiment the convective fins 180 in the housing 170 are enclosed within a cover 182 so as not to be seen from outside the housing 170. It is to be understood that, in other embodiments, the convective fins 180 may be readily viewed from outside the housing 170.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A lighting apparatus, comprising:

a base comprised of an electrically conductive material and a layer of oxide on said material, the base comprising a cavity;

electrically conductive traces mounted on the base, at least a portion of the conductive traces being disposed in the cavity an array of LEDs electrically connected to the conductive traces, at least a portion of the array of LEDs disposed in the cavity;

said LEDs electrically insulated from the conductive material by said oxide; and a selectively removable cover configured to fit over the array of LEDs and to at least partially cover the cavity when in an installed position, the cover comprising an electrically conductive portion;

wherein the electrically conductive portion of the cover is configured to electrically communicate with the conductive traces so that electrical current flows between the cover and the traces when the cover is in the installed position, and electrical current flow is interrupted when the cover is removed from the cavity.

2. The lighting apparatus of claim 1, wherein at least a portion of the cavity is filled with a light transmissive material.

3. The lighting apparatus of claim 1, wherein the base has a substantially flat mounting surface, and additionally comprising a power supply having a substantially flat mounting surface, and the base is mounted flush onto the mounting surface of the power supply.

4. The lighting apparatus of claim 3, wherein the power supply has an electrical supply node, and the electrically conductive portion of the cover is selectively electrically engageable with the power supply node so that electrical current from the power supply flows through the cover to the traces.

5. The lighting apparatus of claim 4 additionally comprising a fastener adapted to selectively and simultaneously engage the electrical supply node of the power supply and the electrically conductive portion of the cover, wherein the fastener is electrically conductive so that electrical current from the power supply flows through the fastener to the conductive portion of the cover.

6. The lighting apparatus of claim 5, wherein the fastener comprises a threaded fastener, and the electrical supply node comprises a threaded portion.

7. The lighting apparatus of claim 1, wherein the oxide is a native oxide of the electrically conductive material.

8. The lighting apparatus of claim 7, wherein a thickness of the oxide layer is about 2 mil or less.

9. The lighting apparatus of claim 7, wherein the oxide layer is produced by anodization.

10. A lighting apparatus, comprising:

a base comprised of an electrically conductive material and a layer of oxide on said material, the base further comprising a cavity and a substantially flat mounting surface;

electrically conductive traces disposed on the oxide, at least a portion of the conductive traces being disposed in the cavity;

an array of LEDs mounted on the base and being electrically connected to the conductive traces so that at least a portion of the array of LEDs is disposed in the cavity, said LEDs electrically insulated from the conductive material by said oxide;

a cover configured to fit over the array of LEDs and to at least partially cover the cavity, the cover comprising an electrically conductive portion that is configured to electrically communicate with the conductive traces so that electrical current flows from the cover to the traces, the cover being selectively removable to interrupt the electrical current flow; and a power supply having a substantially flat mounting surface, the base being mounted on the mounting surface of the power supply;

wherein the power supply has a positive electrical supply node and a negative electrical supply node, and the cover has two electrically conductive portions that are selectively electrically engageable with respective power supply nodes, and each cover portion is selectively electrically engageable with the conductive traces so as to selectively create an electrical pathway between the nodes through the cover portions, the traces and the array of LEDs.

11. A lighting apparatus, comprising:

a base;

an array of LEDs mounted to the base;

a circuit trace disposed on the base and configured to deliver electrical power to the array of LEDs;

a selectively removable cover configured to cover the array, the cover having an electrically conductive portion; and an electrical supply path having an end spaced from the circuit trace;

wherein the cover is mechanically coupled to the base such that the electrically conductive portion communicates with the circuit trace and with the electrical supply path so as to complete an electrical pathway to permit power to flow to the LEDs, and removal of the cover opens the electrical pathway to prevent flow of power.

12. The lighting apparatus of claim 11 additionally comprising a cover contact configured to electrically connect the circuit trace to the cover when the cover is coupled to the base.

13. The lighting apparatus of claim 12, wherein the cover contact is permanently in contact with the circuit trace, and extends from the circuit trace.

14. The lighting apparatus of claim 13, wherein the circuit trace comprises a terminus portion, and the cover contact is affixed to the terminus portion.

15. The lighting apparatus of claim 12, wherein the base is electrically conductive, and the base is coated with a non-electrically-conductive electroless metal, wherein the circuit trace is insulated from the base by the coating.

16. The lighting apparatus of claim 11 additionally comprising a fastener adapted to couple the cover to the base, wherein the electrical supply path comprises the fastener.

17. The lighting apparatus of claim 16 additionally comprising a power supply having an energized mounting node, wherein the fastener is adapted to selectively engage the energized mounting node.

18. A lighting apparatus, comprising:

a base;

an array of LEDs mounted to the base so that the LEDs are electrically connected to one another;

a cover configured to cover the array, the cover comprising a first conductive portion and a second conductive portion; and a first cover contact and a second cover contact electrically connected to the array of LEDs;

wherein power is supplied to the LEDs via an electrical pathway, and the cover is mechanically coupled to the base such that the first and second cover portions are electrically engageable with respective cover contacts when the cover is in place so that attachment of the cover completes an electrical pathway to permit power to flow via an electrical pathway through the first cover portion to the array of LEDs and to the second cover portion, and wherein removal of the cover interrupts the electrical pathway to prevent flow of power.

19. The lighting apparatus of claim 18 additionally comprising a power supply having first and second power supply nodes, and the base and cover are attachable to the power supply so that the first and second nodes electrically communicate with the first and second cover conductive portions.

20. The lighting apparatus of claim 19, wherein the base has a substantially flat mounting surface and the power supply has a substantially complementary mounting surface.

21. An ultraviolet lighting device, comprising a lighting apparatus as in claim 20, wherein the base comprises a cavity, the array of LEDs is arranged in the cavity and comprises LEDs configured to emit ultraviolet light, and the cover is configured to completely enclose the cavity when the cover is in place so that substantially no light emitted by the LEDs exits the cavity without first contacting the cover.

22. The ultraviolet lighting device of claim 21, wherein the cover comprises a phosphor.

23. The lighting apparatus of claim 20, wherein the cover is selectively mechanically coupled to the base and power supply by a first and a second fastener, the first and second fasteners being electrically conductive, and the first and second fasteners communicate electricity from the first and second power supply nodes, respectively, to the first and second cover portions.

24. The lighting apparatus of claim 23, wherein the base is attached to the power supply so that the base mounting surface is fit substantially flush onto the power supply mounting surface.

25. A lighting apparatus, comprising:

a base;

an array of LEDs mounted to the base and electrically communicating with a circuit trace;

a cover configured to cover the array, the cover comprising a fastener and a conductive insert;

wherein power is supplied to the LEDs via an electrical pathway, and the cover is mechanically coupled to the base such that the conductive insert communicates electrical power between the circuit trace and the fastener so that attachment of the cover completes an electrical pathway to permit power to flow to the LEDs, and removal of the cover opens the electrical pathway to prevent flow of power.

26. The lighting apparatus of claim 25, wherein the fastener is a threaded fastener and the insert is threaded so as to mechanically and electrically engage the fastener.

27. The lighting apparatus of claim 25 additionally comprising a housing comprising a heat conductive material, the housing configured so that the base fits therein and in contact with the housing so that heat from the base is communicated to the housing.

28. The lighting apparatus of claim 27, wherein the housing comprises heat dissipating fins.

29. A lighting apparatus comprising:

a base comprising a pair of apertures;

a plurality of contacts on the base, the plurality of contacts comprising a first terminus and a second terminus;

at least one LED disposed on the contacts and arranged so that an electrical pathway is established from the first terminus to the second terminus;

a power module comprising first and second threaded mount portions, the power module configured to supply electric power between the first and second mount portions and comprising a casing that has first and second apertures that enable access to the first and second mount portions, the apertures configured to generally align with the base apertures; and a first conductive fastener and a second conductive fastener, the fasteners being elongate and adapted to fit through the base apertures and the power module apertures to engage the respective mount portions;

wherein the first and second conductive fasteners are adapted to engage the first and second mount portions, respectively, so as to hold the base in a position relative the power module and to electrically connect the first and second mount portions to a respective one of the first and second terminus so as to supply electrical power across the electrical pathway when the fasteners are in place, and wherein the first and second mount portions are threaded, and the first and second fasteners are threaded so as to engage the mount portion threads.

30. The lighting apparatus of claim 29, wherein the base is thermally conductive.

31. A lighting system comprising a housing and a plurality of the lighting apparatuses of claim 30, wherein the lighting apparatuses are electrically linked together and the housing is configured to hold the plurality of lighting apparatuses so that the bases of the apparatuses contact the housing, and wherein the housing comprises a thermally conductive material adapted to receive heat from the base.

32. The lighting apparatus of claim 29, wherein the base has a substantially flat mounting surface and the power module has a substantially complementary mounting surface, and the base mounting surface is mounted substantially flush onto the power module mounting surface.

33. The lighting apparatus of claim 29, wherein the power module is connected to a source of electrical power, and the power module is adapted to convert the electrical power to a desired condition.

34. A lighting apparatus comprising:

a base having a first aperture and a second aperture;

a plurality of contacts on the base, the plurality of contacts comprising a first terminus and a second terminus, the first base aperture generally adjacent the first terminus and the second base aperture generally adjacent the second terminus;

at least one LED disposed on the contacts and arranged so that an electrical pathway is established from the first terminus to the second terminus;

a power module comprising first and second mount portions, the power module configured to supply electric power between the first and second mount portions; and a first conductive fastener and a second conductive fastener;

wherein the first and second conductive fasteners are adapted to engage the first and second mount portions, respectively, and extend from the power module mounting portions and through the first and second apertures, respectively, of the base so as to hold the base in a position relative the power module and to electrically connect the first and second mount portions to a respective one of the first and second terminus so as to supply electrical power across the electrical pathway when the fasteners are in place; and wherein a cover is adapted to fit over the at least one LED, and the fasteners physically connect the cover to the base.

35. The lighting apparatus of claim 34, wherein each terminus comprises an upwardly extending contact member.

* * * * *